US005373214A

United States Patent [19]

McCready

[11] Patent Number: 5,373,214

[45] Date of Patent: Dec. 13, 1994

[54] SPARK PLUG AND ELECTRODE ARRANGEMENT THEREFOR

[76] Inventor: David F. McCready, R.D. 4, Box 185, Altoona, Pa. 16601

[21] Appl. No.: 897,823

[22] Filed: Jun. 12, 1992

[51] Int. Cl.[5] ..... H01T 13/20

[52] U.S. Cl. ..... 313/142; 313/141; 313/139; 123/169 EL

[58] Field of Search ..... 313/139, 140, 141, 142; 123/169 EL, 169 EB, 169 EC

[56] References Cited

U.S. PATENT DOCUMENTS

| | | | |
|---|---|---|---|
| 2,031,293 | 2/1936 | Wamelink | 313/141 X |
| 2,371,162 | 3/1945 | Field | 313/142 X |
| 3,597,648 | 8/1971 | Shibagaki | 313/143 |
| 3,940,649 | 2/1976 | Berstler | 313/141 X |
| 4,015,160 | 3/1977 | Lara et al. | 313/142 X |
| 4,023,058 | 5/1977 | Lara et al. | 313/141 X |
| 4,983,877 | 1/1991 | Kashiwara et al. | 313/142 X |
| 5,007,389 | 4/1991 | Kashiwara et al. | 313/141 X |

FOREIGN PATENT DOCUMENTS

| | | | |
|---|---|---|---|
| 1294769 | 4/1962 | France | 313/141 |

*Primary Examiner*—Donald J. Yusko
*Assistant Examiner*—Ashok Patel
*Attorney, Agent, or Firm*—James Creighton Wray

[57] ABSTRACT

The present invention provides an improved spark plug and electrode arrangement therefor. A central electrode has a sparking end adjacently positioned to and mated with a spark-receiving end of an outer electrode. At least one of the electrode ends has a protrusion extending towards the other electrode, and the other electrode has a geometrically mated indentation. A relatively uniform spark gap having increased surface area is provided therebetween. Hemispherical or rounded and conical protrusions and mated indentations are preferred embodiments of the present invention. The present spark plug electrode arrangement provides increased area sparks, regulates sparks under varied conditions and decreases incidence of carbon build up.

8 Claims, 2 Drawing Sheets

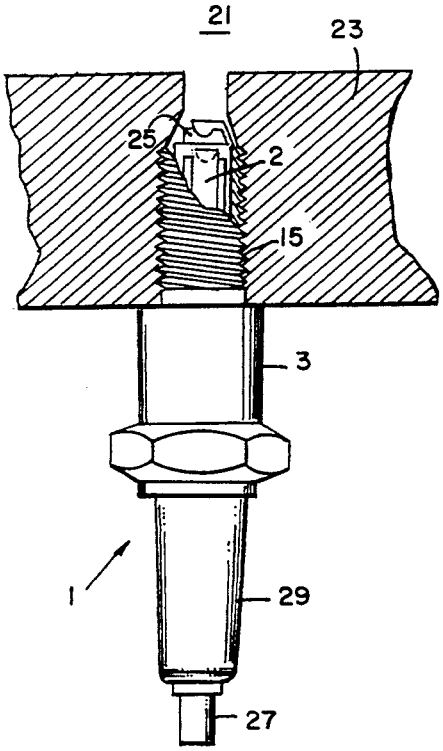
FIG. 3
FIG. 4
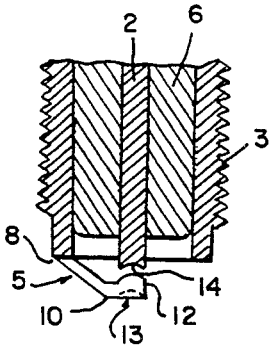
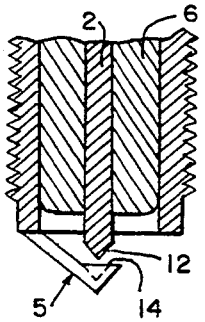
FIG. 6
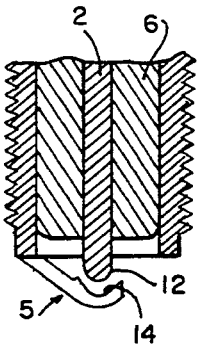
FIG. 5
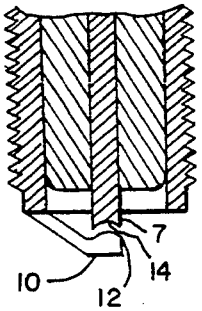
FIG. 7

SPARK PLUG AND ELECTRODE ARRANGEMENT THEREFOR

BACKGROUND OF THE INVENTION

The present invention relates to spark plugs, specifically the arrangement of electrodes in spark plugs.

A typical spark plug has an inner electrode axially positioned within an insulated sheathing and further within a metal casing. The casing has threads for fitting within the block of an engine. The inner electrode has a firing system attachment end and an opposite sparking end, which extends beyond the sheathing towards an outer electrode. The outer electrode has a spark-receiving end and an opposite end attached to the metal casing. The firing system provides a current to the inner electrode and causes a spark to arc from the inner electrode sparking end to the outer electrode spark-receiving end. As the spark plug extends into a combustion chamber of an engine, the spark ignites the flammable vapor within the chamber and drives a piston.

Many problems exist with present spark plugs. Voltage variations due to engine load and variations in chamber pressures cause variation in spark size, malfunction in sparking, and otherwise erratic firing of the ignition system. Standard spark plugs incorporate small area electrode ends, reducing spark size and enabling carbon to build up on the ends.

A need exists for an increased surface area electrode arrangement, which provides adjustment for firing voltage and pressure variations and resists or hinders carbon buildup. A need also exists for an electrode arrangement which creates a larger, uniform spark which decreases chamber ignition time, thus increasing pressure on the head of the piston.

SUMMARY OF THE INVENTION

The present invention provides an improved electrode arrangement for spark plugs. In the preferred embodiment, the present spark plug incorporates an axially extending inner or central electrode having a firing system connection end and a sparking end extending from an insulated sheathing surrounding the central electrode. A metal casing surrounds the sheathing and has threads for attachment to an engine block. An outer electrode is attached to the metal casing at one end and a spark-receiving end which extends over the sparking end of the central electrode.

The increased area electrode combination for a spark plug has a central electrode encased in an insulated sheathing. A metal casing surrounds the sheathing. An outer electrode extends from one end of the casing and has a spark-receiving end. The central electrode has one end extending out of the insulated sheathing and defining a spark discharging surface. The spark discharging surface and spark-receiving end of the two electrodes are positioned adjacently and are provided with mated geometric discharge and receiving surfaces respectively. The mated relationship of the surfaces are male and female and provide a sparking gap therebetween.

The mated relationship of the two electrodes can be a hemispherical protrusion extending from one electrode towards a mated hemispherical indentation in the other electrode.

In one embodiment, the hemispherical protrusion is provided on the end of the center electrode, and the hemispherical indentation is provided on the outer electrode. Alternatively, the hemispherical protrusion is provided on the outer electrode, and the hemispherical indentation is provided on the end of the center electrode.

In another form of the invention, the mated relationship of the two electrodes is a conical protrusion provided on one of the electrodes extending towards a conical indentation on the other electrode. The conical protrusion can be provided on the end of the central electrode and the conical indentation is provided on the outer electrode; or the protrusion can be provided on the outer electrode with the conical indentation provided on the end central electrode.

A preferred outer electrode has an open ended cavity provided in the conical or hemispherical protrusion opposite the mated electrodes.

In one embodiment, the male and female mated structures are approximately equidistant along opposite mated surfaces and define the sparking gap therebetween.

These and further and other objects and features of the invention are apparent in the disclosure, which includes the above and ongoing written specification, with the claims and the drawings.

BRIEF DESCRIPTION OF THE DRAWINGS

FIG. 3 is a side view of the installed spark plug with electrodes proximal the firing chamber.

FIG. 4 is a cutaway side view of a preferred electrode arrangement showing a hemispherical protrusion on the spark-receiving end and complementary indentation on the sparking end.

FIG. 5 is a cutaway side view of the sparking end incorporating a hemispherical protrusion.

FIG. 6 is a cutaway side view of an alternative arrangement showing a conical protrusion on the sparking end and a conical receiver on the spark-receiving end.

FIG. 7 is a cutaway side view showing trapezoidal mated structures.

DETAILED DESCRIPTION OF THE DRAWINGS

Figure 1:
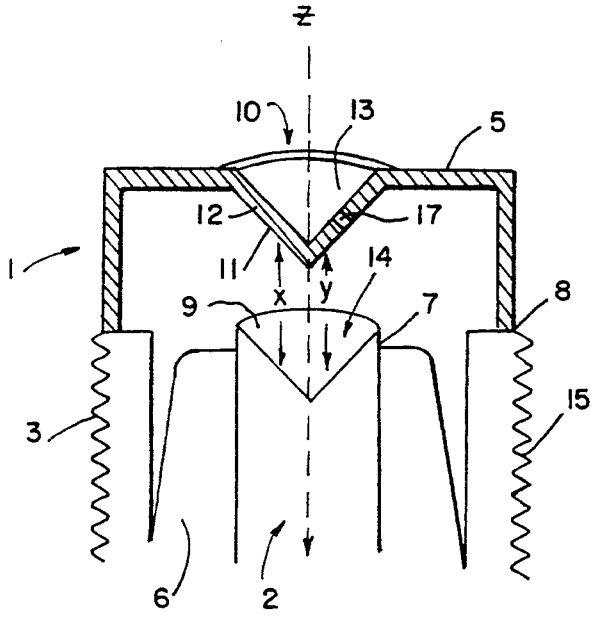
FIG. 1 is a cutaway side view of the spark plug firing and electrode arrangement.
Figure 2:
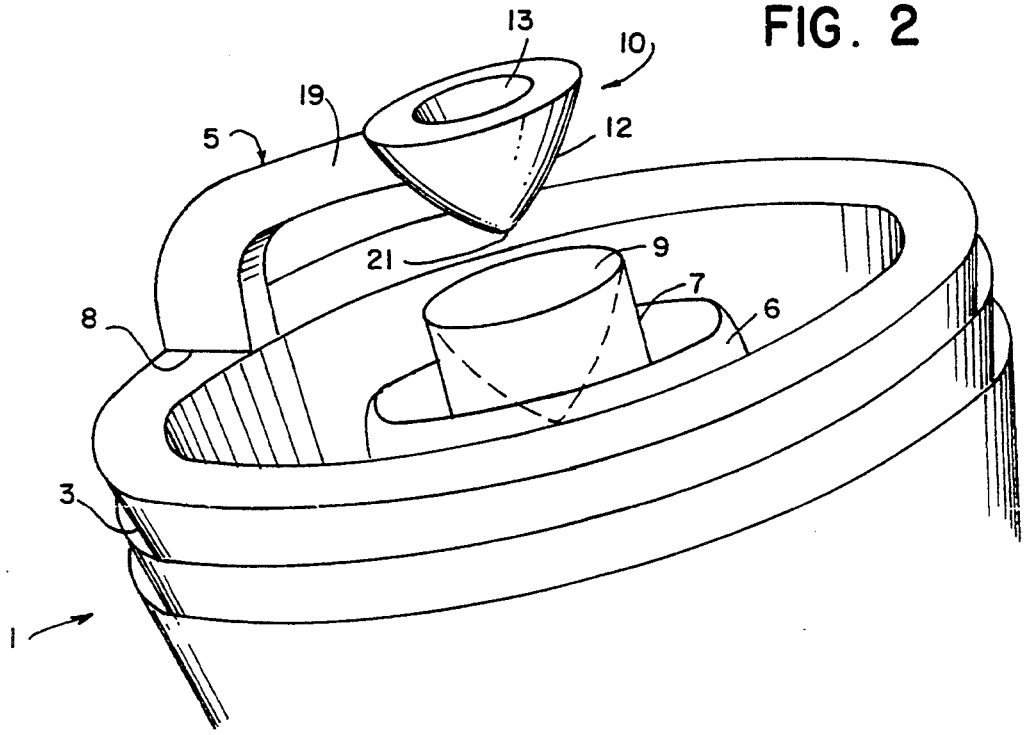
FIG. 2 is a close up elevated view of a preferred electrode arrangement.

A spark plug, generally indicated by the numeral 1 in FIG. 1 of the present invention, incorporates a central or inner electrode 2, an insulated sheathing 6, a metal casing 3 surrounding the sheathing 6, and an outer electrode 5 connected to the sheathing 3. The outer electrode 5 can be a double bracket apparatus as shown in FIG. 1, or a single armature apparatus as shown in FIG. 2. The outer electrode 5 has a casing connection end 8 and a spark-receiving end 10. The central electrode 2 has a sparking end 7 extending from the sheathing 6. A sparking surface 9 mates with a spark-receiving surface 11 on the spark-receiving end 10.

With the present invention, at least one of the sparking end 7 or spark-receiving end 10 is provided with a protrusion 12 to mate with an indentation 14 on the opposite electrode end. As shown in FIG. 1, the preferred embodiment provides the protrusion 12 on the spark-receiving end 10 extending towards the indentation 14 provided on the sparking end 7. Preferably, the central electrode is axially positioned within the spark plug along axis Z, and the protrusion 12 and mated indentation 14 are axially aligned therewith. The protrusion and indentation are male and female mated structures, and in a preferred embodiment, distances, such as X and Y and along axis Z, between the mated surfaces are equidistant to create a uniform sparking gap therebetween.

In a preferred embodiment, the receiving end 10 may incorporate an open ended cavity 13 within the protrusion opposite the mating of the two electrodes. The cavity 13 may be the approximate geometrical equivalent of the protrusion, thereby providing a protrusion thickness 17 which is approximately the same throughout the protrusion.

It is preferable for the mated female and male electrodes to be approximate geometric equivalents.

As shown in FIG. 2, the receiving end 10 is positioned adjacent the sparking end 7, and can be held thereby by a relatively thin armature 19 extending from the casing connection 8. The conical protrusion 12 may have a tip 21 which is rounded, pointed or truncated, as specified in design of manufacture. Though it is preferable for the indentation to be a geometric equivalent mate of the protrusion, alterations between the shapes of the protrusion and indentation are not beyond the scope of the invention.

The preferred spark plug 1, as shown in FIG. 3, shows the plug screwed into an engine block 23. Threads 15 provided on the casing mate with threads within the engine block, forming an electrical connection therebetween and grounding the plug to permit electrical current flow therethrough. The central electrode 2 has a firing system connection end 27 for connection to the firing system of an engine. The current flows through the connection end 27 to the sparking end. The outer electrode is grounded through its connection with the engine casing attached to the engine block, and the current arcs from the sparking end across a spark gap 25 to the receiving end, igniting fuel within a combustion chamber 21. It is preferable to provide as large and consistent a spark as possible to uniformly and quickly ignite the fuel and provide the greatest possible force on a piston. The present invention provides a larger area between the mated surfaces of the sparking and receiving surfaces, thus creating a larger spark.

FIGS. 4–7 disclose preferred sparking and receiving end arrangements.

FIG. 4 shows a hemispherical or rounded protrusion provided on the receiving end and the mated indentation on the sparking end.

FIG. 5 shows the opposite arrangement, with the hemispherical protrusion provided on the sparking end extending from the insulated sheath.

FIG. 6 shows a conical projection 12 extending from the central electrode 2, and an oppositely mated conical indentation 14 in the receiving end of the outer electrode 5. Though conical and rounded or hemispherical projections and indentations have been shown and described in detail, other geometric shapes, such as trapezoidal protrusions 12 and indentations 14, as shown in FIG. 7, can be oppositely mated between the receiving end 10 and the sparking end 7. Other geometric figures may include truncated structures with angled or sloped sides, or structures with concentric ridges. It is not beyond the scope of the invention to provide several projections and matching indentations on opposite electrodes.

While the invention has been described with reference to specific embodiments, modifications and variations of the invention may be constructed without departing from the scope of the invention, which is defined in the following claims.

I claim:

1. An increased area electrode combination for a spark plug comprising a spark plug having a central electrode encased in an insulated sheathing, a metal casing surrounding the sheathing, an outer electrode extending from one end of the casing and having a spark-receiving end, the central electrode having one end extending from the insulated sheathing and defining a spark discharging surface, the spark discharging surface and spark-receiving end of the two electrodes positioned adjacently and provided with mated geometric discharge and receiving surfaces respectively, the mated relationship of the surfaces being male and female and providing a sparking gap therebetween, further comprising the mated relationship of the two electrodes being a hemispherical protrusion extending from one electrode towards a mated hemispherical indentation in the other electrode, wherein the protrusion is a conical protrusion provided on one end of the central electrode and the indentation is a conical indentation on the outer other electrode, with the conical protrusion extending towards the conical indentation.

2. The apparatus of claim 1, further comprising the outer electrode incorporating an open ended cavity provided in the conical protrusion opposite the mated electrodes.

3. A spark plug electrode arrangement comprising an axially extending central electrode having a sparking end and an outer electrode having a spark-receiving end provided in close relation to the sparking end, a sparking gap provided therebetween, one of the sparking end or spark-receiving ends incorporating a protrusion extending towards a mated indentation in the other end, further comprising the protrusion and indentation being axially aligned with the axially extending central electrode, the protrusion and indentation being approximately equivalent male and female structures, wherein the protrusion is a conical structure and the indentation is conical, with the conical protrusion extending towards the conical indentation.

4. The apparatus of claim 3, further comprising the male and female mated structures being approximately equidistant along opposite mated surfaces and defining the sparking gap therebetween.

5. The apparatus of claim 3, further comprising the protrusion provided on the spark-receiving end extending towards an indentation provided on the sparking end.

6. The apparatus of claim 5, further comprising an open ended cavity provided on the receiving end opposite the protrusion.

7. The apparatus of claim 3, further comprising the protrusion provided on the sparking end extending towards the indentation provided on the receiving end.

8. The apparatus of claim 3, further comprising the protrusion being a hemispherical structure extending towards a hemispherical indentation.

* * * * *